US005544441A

United States Patent [19]

Mahn et al.

[11] Patent Number: 5,544,441

[45] Date of Patent: Aug. 13, 1996

[54] MUZZLE LOADING WEAPON IGNITION SYSTEM

[76] Inventors: Gary Mahn, 9470 Oriole Dr., Coopersville, Mich. 49404; Gary Bowman, 871 Dolphin SW., Wyoming, Mich. 49509

[21] Appl. No.: 210,720

[22] Filed: Mar. 18, 1994

Related U.S. Application Data

[62] Division of Ser. No. 954,502, Sep. 29, 1992, Pat. No. 5,307,583.

[51] Int. Cl.[6] ..... F41C 27/00; A45F 5/00

[52] U.S. Cl. ..... 42/106; 42/90; 224/249

[58] Field of Search ..... 42/106, 90; 224/918, 224/249, 251

[56] References Cited

U.S. PATENT DOCUMENTS

| | | | |
|---|---|---|---|
| 635,145 | 10/1899 | Orndorff | 224/219 |
| 1,603,044 | 10/1926 | Gise | 224/221 |
| 2,410,200 | 10/1946 | Celestin | 224/219 |
| 3,578,152 | 5/1971 | Hartley | 224/249 |
| 3,840,995 | 10/1974 | Freiling | 33/233 |
| 4,069,954 | 1/1978 | Rauch | 224/219 |
| 4,094,098 | 6/1978 | Gourley | 42/90 |
| 4,589,220 | 5/1986 | Lofland | 42/90 |
| 4,830,246 | 5/1989 | Ryan | 224/219 |
| 4,896,465 | 1/1990 | Rhodes et al. | 224/219 |
| 5,092,072 | 3/1992 | Fritts . | |

*Primary Examiner*—David Brown

*Attorney, Agent, or Firm*—Varnum, Riddering, Schmidt & Howlett

[57] ABSTRACT

A radially loading ignition system for a muzzle loading weapon generally comprises a body having threads on its outer surface and a well sunk into one end for loosely holding a shotgun shell primer; a first opening through the side of the well for passing the primer into the well radially; and a rotatable cover enclosing the well and having a second opening which is aligned with the first opening for loading the primer and which is rotated out of alignment with the first opening for closing the ignition system. The ignition system is suitable for use in muzzle loading weapons using either an in-line firing system or a conventional swing hammer. A spare primer holder is also disclosed which comprises a semi-circular ring of elastomeric material adapted to snap onto a rifle scope or barrel and having a series of holes for frictionally receiving spare primers.

6 Claims, 7 Drawing Sheets

MUZZLE LOADING WEAPON IGNITION SYSTEM

This is a division, of Application Ser. No. 07/954,502 filed Sept. 29, 1992, now U.S. Pat. No. 5,307,583.

BACKGROUND OF THE INVENTION

1. Field of the Invention

This invention relates generally to rifles, and more particularly to a muzzle loading rifle with an improved ignition system.

2. State of the Prior Art

Hunting with muzzle loading rifles has become increasingly popular in the last few years. Many hunters prefer to use muzzle loading rifles because a game animal has a greater chance to escape with its life, thus the hunter's skill can be more adequately tested. Some hunters also enjoy the muzzle loading routine of pouring powder down the rifle barrel, packing it, and driving a shot down the barrel. Some states even have a separate hunting season for sportsmen with muzzle loading firearms.

Hunting with muzzle loading rifles presents several additional challenges. Most muzzle loading weapons used by hunters fire by means of a cup shaped percussion cap which contains a small explosive charge ignitable upon application of a sufficient impact. The percussion cap is placed over a nipple. A passage way through the nipple and into the barrel of the weapon passes the hot gasses produced when the percussion cap is ignited. Typically the muzzle loading hunting season occurs at a time of the year when the weather is cold and inclement. Percussion caps are well known for being an unreliable ignition source in such weather. They absorb moisture and may become waterlogged and unusable. Also, they contain only a small charge. A further inconvenience of percussion caps becomes apparent when a hunter attempts to remove a spent cap from the nipple in the field. Sometimes the cap is very difficult to pry off of the nipple, especially with cold fingers.

To overcome the inadequacies of percussion caps as an ignition source, some gun designers employ shot gun shell primers as an ignition source. Shot gun shell primers are primarily used as the ignition source for shotgun shells for regular breech loading shotguns, but make an excellent ignition source for a muzzle loading weapon. They comprise a tubular metal casing, an annular flange at one end of the casing and extending outwardly radially therefrom, a charge of explosive material, and a hole at the opposite end from the flange for expelling the hot gasses from the explosion.

Shot gun shell primers are much less susceptible to the ravages of damp weather and rarely become water logged unless immersed in water. Shot gun shell primers also contain a much larger charge of explosive material for a more reliable ignition of the black powder charge. However, previous ignition systems for muzzle loading weapons designed to use shot gun shell primers as an ignition source require that the primer be inserted axially (in the direction that the hot ignition gasses will escape) into a tight fitting well until the annular flange prevents the primer from being inserted further. The primer must fit snugly into the well to prevent it from falling out. Many times gasses and ash blowing back into the ignition system from the exploding black powder charge dirties the well. When this happens, the primer is very difficult to insert and remove. Even when the well is relatively clean the primer is difficult to remove with cold hands.

A second problem with muzzle loading weapons is accuracy. One element of inaccuracy is a relatively long lock time compared with conventional breech loading weapons. Lock time is measured from the time the trigger is squeezed until the black powder charge launching the bullet actually fires. Many muzzle loading weapons employ a traditional swing hammer mounted on the side of the barrel, which swings through an arc and strikes a percussion cap. The hot gasses from the cap must travel a long, and sometimes circuitous path, into the barrel before igniting the black powder charge. Also, if only the side of the charge is ignited it may not burn evenly. The longer the lock time, the longer the shooter has to hold the rifle steady and on target. Even very small delays can cause inaccuracies due to the physical inability of even the best shooters to hold the weapon completely still. Small movements of the rifle greatly affect the bullet's path.

To reduce lock time it is desireable to have a fast hammer and a short direct path from the ignition source into the black powder charge. Recently in-line firing systems have gained some popularity for their inherently faster lock times, thus higher accuracies. The firing mechanism and ignition source are lined up immediately behind the black powder charge to reduce the distance the hammer has to travel and also the distance that the hot gasses have to travel. The gasses enter the barrel axially to reduce uneven burning of the black powder charge. If used with a shot gun shell primer, lock time may be further reduced by providing a hotter spark to more quickly ignite the black powder charge.

A drawback of such systems is the awkward placement of the percussion cap nipple or primer well inside the barrel. Typically they are accessed through an opening in the side of the barrel. Access is difficult because of the small space for putting one's fingers. In cold weather, access is even more difficult due to the limited mobility of cold fingers.

SUMMARY OF THE INVENTION

The present invention overcomes the disadvantages of difficult loading and removal of primers, making them a practical ignition source for in-line or other firing systems. It provides an easy method of inserting and removing shot gun shell primers; the well is sized to receive the primer loosely to prevent sticking, and accepts the primer from the side for easier loading. Conventional swing hammer weapons may also benefit from the easy loading and improved reliability of the present invention. The ignition system is suitable for retrofit to existing weapons or as original equipment in new weapons.

An ignition mechanism, according to the invention, is provided for use in a muzzle loading firearm having a barrel bore and a firing pin. The mechanism comprises a body having at least one wall partially defining a receiving chamber. The wall separates opposing ends of the receiving chamber and has a loading slot. The body has a spark port extending from one end of the receiving chamber through the body. Firing means on the body at the other end of the receiving chamber facilitate ignition of a primer charge by the firing pin when the receiving chamber is loaded. The body is further configured to be mounted to the firearm with the spark port in communication with the barrel bore, and a cover is mounted to the body in a position to cover the loading slot.

The cover can be rotatable about a central axis of the body, and the rotation may be by means of mating threads on the cover and the body. The threads on the cover and body may be oriented so that when the cover is closed with the primer charge inside the ignition mechanism, friction thereby developed in the threads will tend to keep the cover closed.

The cover can have an opening whereby when the loading slot and opening are in register, the primer charge may be inserted into the chamber. The cover may be configured so that when the primer slot and opening are out of register, the primer charge is held-securely within the chamber.

The chamber can have a circular cross section. Typically, the primer charge comprises a cylindrical casing enclosing an explosive charge. An annular flange at one end extends outwardly radially from the casing, and an opening is provided at the opposite end for expelling hot gasses produced when the explosive charge is ignited. The chamber is sized to loosely receive the primer charge casing. The chamber further comprises an annular edge, formed at the opposite end from the spark port, which receives the annular flange on the primer charge casing. The primer slot interrupts the annular edge. The cover can be rotatable about the body by means of mating threads on the cover and the body.

Preferably, the ignition mechanism is constructed so that the spark port is coaxial with the bore of the barrel. The primer charge for the ignition mechanism typically comprises a shotgun shell primer.

In another aspect of the invention, a muzzle loading weapon comprises a barrel having an axial bore and an ignition system. The ignition system comprises a body having a chamber for holding an impact ignitable ignition source. The ignition source has a casing, and an explosive charge within the casing. The ignition source is ignitable by means of an impact against its exterior thereby expelling a stream of hot gases through a breach in the casing. The stream of hot gases defines a first direction. A first opening in the chamber is sized and oriented to closely pass the ignition source into the chamber in a second direction which is different from the first direction. A cover is provided for covering the first opening and holding the ignition source within the chamber.

The cover is preferably rotatable about a central axis of the ignition system in the first direction. The cover can have a second opening whereby when the first opening and second opening are in register, the ignition source may be inserted into the ignition system through the openings. The cover can be constructed so that when the first and second openings are out of register, the ignition source is held securely within the ignition system.

The cover comprises a hollow cylindrical section with a wall at a first end and which is open at an opposite second end; the chamber of the body being coaxially received within the cover through its second end. The wall of the cover further comprises a hole for passing a firing pin of the weapon for impacting and igniting the ignition source.

Typically, the barrel of the weapon has an internal threaded section and the body has an external threaded section adapted to mate with the internal threaded section.

In a method for loading a shotgun shell primer into an ignition system of a muzzle loading weapon as an ignition source for the weapon, wherein the primer comprises a casing containing an charge which explodes and expels hot gasses from a portion thereof when struck with a sufficient force; the method comprises: inserting the primer into the ignition system through a first opening in a direction substantially different from the direction which the hot gasses exit the primer; covering the first opening to hold the primer within the ignition system in preparation for ignition. The method can further comprise aligning a second opening in a rotatable cover with the first opening before inserting the primer and the first opening can be covered by rotating the cover until the first and second openings are no longer in alignment.

A holder for spare primers according to the invention comprises a semicircular ring of elastomeric material adapted to snap onto a rifle sighting scope, and holes through the ring for receiving a primer and sized to hold the primer by friction.

BRIEF DESCRIPTION OF THE DRAWINGS

The invention will now be described with reference to the accompanying drawings in which.

DETAILED DESCRIPTION OF THE DRAWINGS

Figure 1:
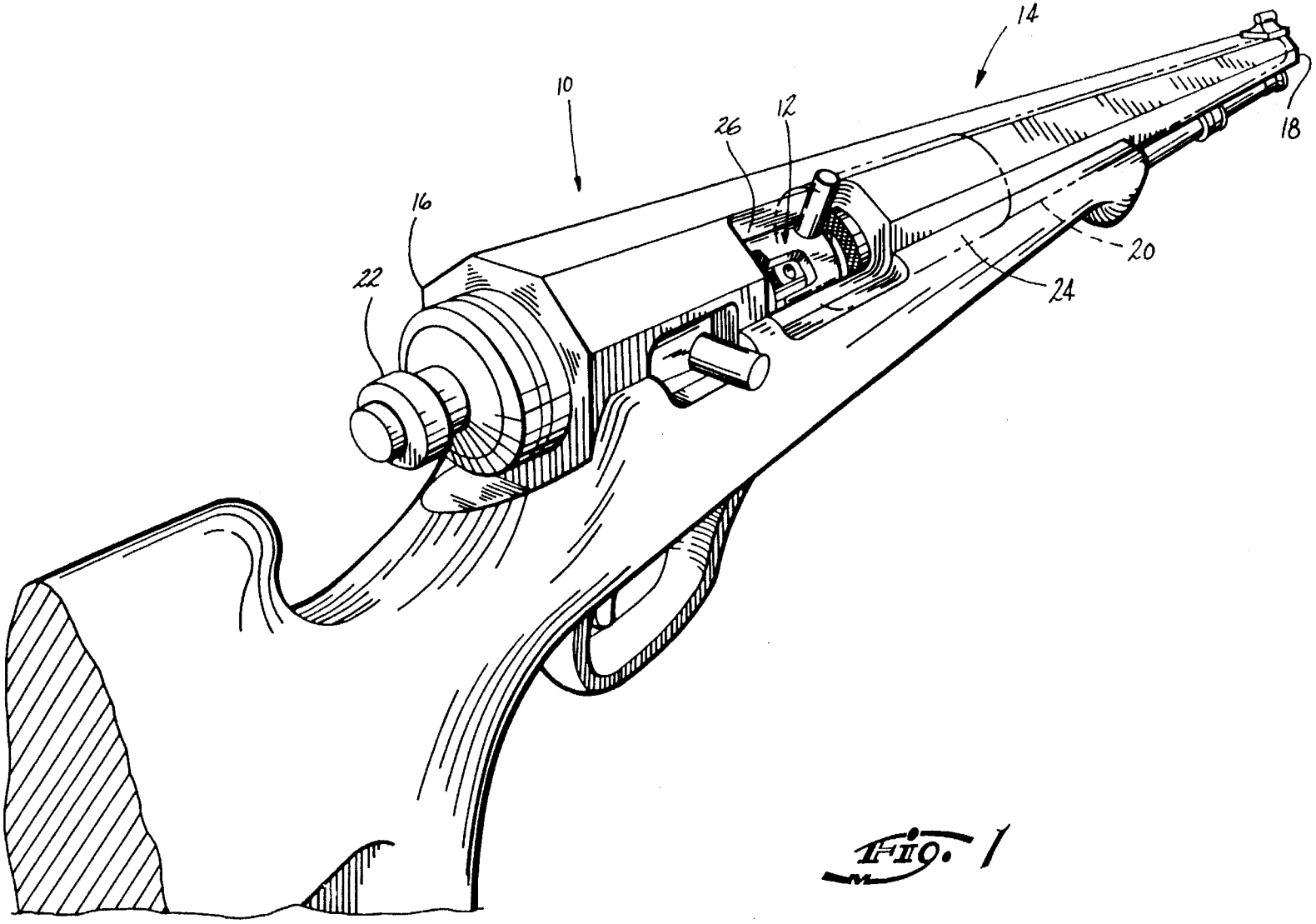
FIG. 1 is a perspective view of an in line firing muzzle loading rifle incorporating an ignition system according to the invention.

Referring now to the drawings, FIG. 1 shows a muzzle loading rifle 10 incorporating an ignition system 12 according to the present invention. The rifle 10 comprises a barrel 14 having a rear or breech end 16 and a forward end 18 and a bore 20 therethrough. A bolt 22 is axially aligned with the bore 20 of the barrel and extends into the bore 20 from the breech end 16 of the barrel 14. The bolt 22 is spring loaded and enable the gun 10 to be fired in a conventional manner. The U.S. Pat. No. 4,700,499 to Knight issued Oct. 20, 1987, more fully illustrates the structure and operation of a conventional in line firing bolt such as that illustrated at 22.

The muzzle loading rifle 10 incorporates a breech plug 24 near the breech end 16 of the barrel 14. An opening 26 through the side of the barrel 14, to the rear of the breech plug 24, provides access to the ignition system 12. When the rifle 10 is loaded, a charge of black powder, wadding and shot (not shown) sits in the bore 20 of the barrel 14 just forward of and against the breech plug 24.

Figure 3:
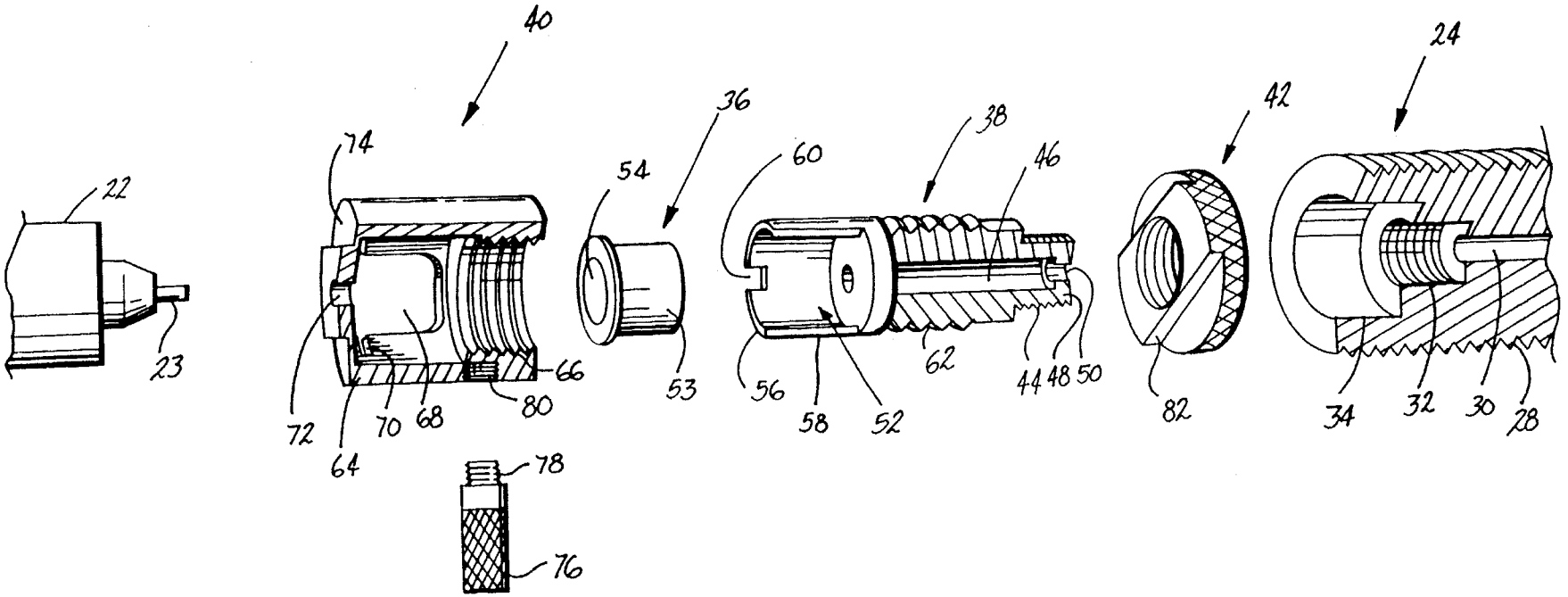
FIG. 3 is an exploded partial sectional side view of the ignition system of FIG. 1.

As seen in FIG. 3, the breech plug 24 is cylindrical and has threads 28 on its outer surface which engage corresponding threads in the bore of the barrel 20 (not shown). A central bore 30 passes axially through the breech plug 24 and is generally coaxial with the bore of the barrel 20 (not shown in FIG. 3), when the breech plug 24 is installed therein. An intermediate threaded bore 32 is countersunk into the rear end of the breech plug 24 and is coaxial with the breech plug central bore 30. An outer bore 34 is countersunk into bore 32, is not threaded, has a somewhat larger diameter than bore 32, and is generally coaxial to the intermediate and central bores 32 and 30.

In prior art weapons, a percussion cap nipple (not shown) would be screwed into the intermediate bore 32 and adapted to receive a cup shaped percussion cap (not shown). The conventional percussion cap nipple for an in-line fired rifle 10, has a central bore axially aligned with the breech plug central bore 30. The gun 10 was fired when the bolt 22 struck and ignited the percussion cap. Hot gasses from the percussion cap traveled through nipple, the central bore 30 of the breech plug 24 and into the charge of black powder in the barrel 14 of the rifle 10. The ignition system 12 of the present invention is adapted to replace the percussion cap nipple.

Figure 2:
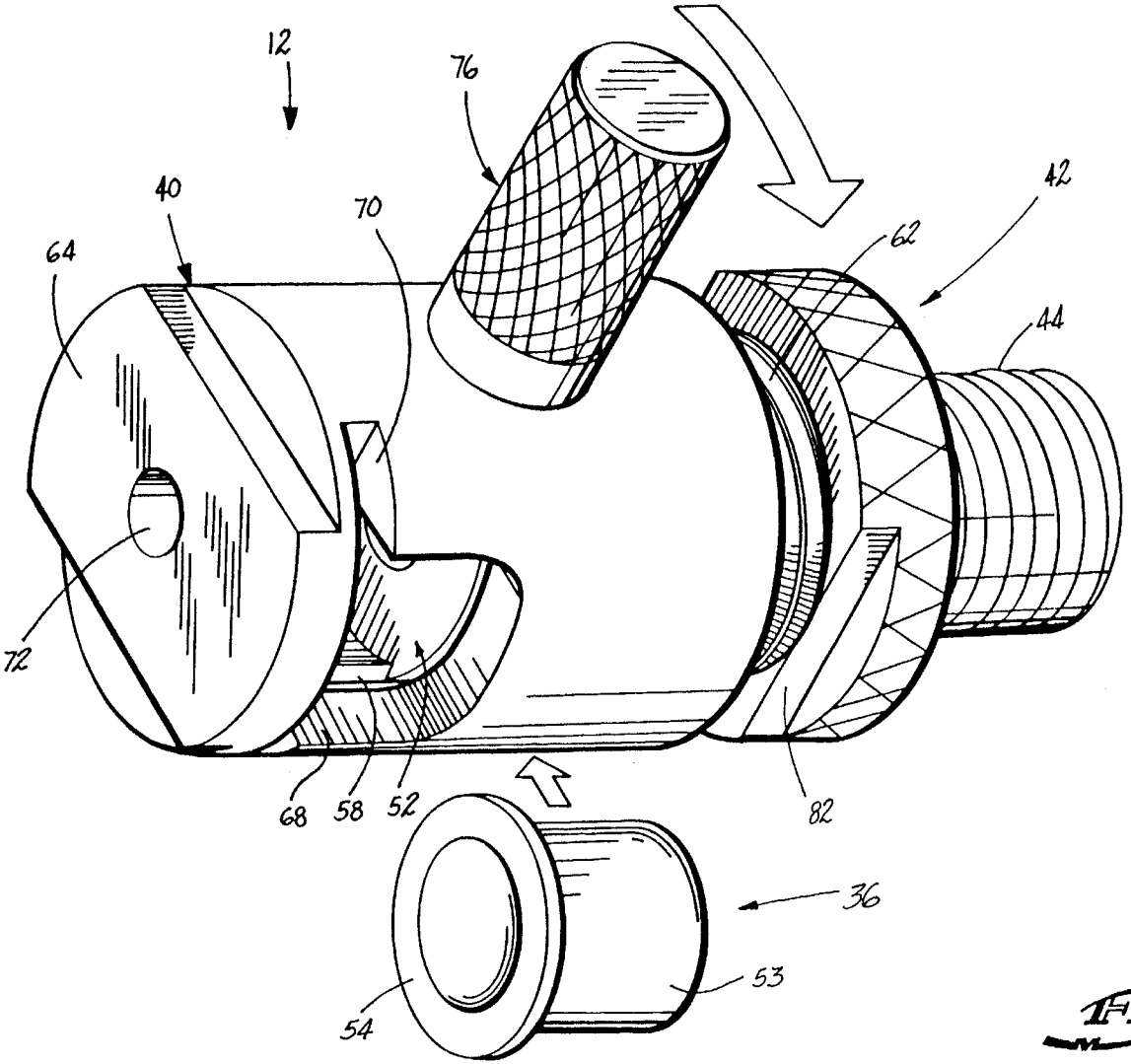
FIG. 2 is a close up perspective view of the ignition system of FIG. 1, without the breech plug.

Turning now to FIGS. 2 and 3, the ignition system 12 is adapted to use a standard shotgun shell primer 36 as an ignition source in place of a percussion cap. An example of a suitable primer 36 is a Model 209 type primer commercially available from Remington Arms Company, Inc., Bridgeport, Conn. The shotgun shell primer 36 comprises a cylindrical casing 53 having an annular flange 54 at one end which extends outwardly radially from the casing 53 of the primer 36. Shotgun shell primers 36 are much more reliable ignition sources than standard percussion caps; they carry a larger charge and are better sealed from the environment. The first embodiment of the ignition system 12 according to the invention is adapted to replace the percussion cap nipple in an existing weapon so that it may be fired by means of the shotgun shell primer 36.

The ignition system 12 broadly comprises a cylindrical body 38, a coaxial rotatable cover 40 mounted thereon, and a locking collar 42 threaded onto the body 38. As more clearly seen in FIG. 3, the body 38 comprises a cylindrical threaded shank 44 at its forward end, adapted to screw into the threaded intermediate bore 32 of the breech plug 24 in place of the percussion cap nipple. A central bore 46 passes coaxially through almost the entire length of the body 38 and terminates to form a wall 48 at the front end of the body 38. A narrower bore 50, coaxial with the central bore 46, penetrates the wall 48 and connects with the central bore 46. A primer chamber 52 for receiving the shotgun shell primer 36 is located at the breech end of the body 38.

The primer chamber 52 comprises a countersunk well coaxial with the bore of the barrel 20 and adapted to receive a shotgun shell primer 36. The primer chamber 52 receives the casing 53 of the primer 36. The rear end of the body 38 with the primer chamber 52 bored therethrough, forms an annular edge 56 for receiving the annular flange 54 of the primer 36. A primer shaped cutout 58 in the wall of the primer chamber 52 allows the primer 36 to pass radially into the primer chamber 52. The cutout 58 interrupts the annular edge 56 and extends axially therefrom for the full length of the primer chamber 52 bore. A smaller cutout 60 interrupts the annular edge 56 opposite the primer cutout 58. The smaller cutout 60 allows some of the blow back gasses from the exploding black powder charge to escape, and also can receive a tool for installing the body 38 into the rifle 10. A threaded section 62 of the outer surface of the body 34, between the shank 44 and the primer chamber 52, receives the cover 40.

The cover 40 is tubular having a circular cross section and is closed at one end by a bulkhead 64. Internal threads 66 at the open end engage the threads 62 on the body 34. The cover 40 screws onto the body 34 such that the primer chamber 52 in the body 34 is received and enclosed within the cover 40. A primer shaped cutout 68 in the side of the cover 40 adjacent the bulkhead 64 is sized to pass the casing 53 of the primer 36. A transverse slot 70 in the body 40, immediately adjacent the bulkhead and connected to the cutout 68 passes the flange 54 of the primer 36. The slot 70 can be cut slightly longer than necessary to pass the flange 54, to provide a larger escape passage for blow back gases produced by the exploding black powder charge.

An opening 72 through the center of the bulkhead 64 allows a firing pin 23, on the forward end of the bolt 22, to pass into the cover 40 for striking the primer 36 to fire the gun 10. Parallel flats 74 cut as chords partially into opposite sides of the outer surface of the bulkhead 64 provide a gripping surface for a tool to unscrew the cover 40 from the body 38. A lever 76 can be provided for easier rotation of the cover 40 about the body 38. The lever 76 should be removable so that the cover 40 can be inserted into the barrel 14 through the breech end 16. Preferably, the lever has a cylindrical shape and threads 78 on one end which thread into a threaded hole 80 on the cover to removably attach the lever 76 to the cover 40.

The invention is not limited to covers which rotate by means of screw threads, and many variations are possible. For instance, the cover may rotate and have no axial component to its movement. Non-rotatable covers may also be employed. For instance the cover may slide over the primer cutout 58 in the axial direction. However, the rotatable cover 40 shown in FIGS. 1–3 is preferred for its simplicity and ease of operation.

The locking collar 42 fixes the orientation of the body 38 with respect to the breech plug 24. The locking collar 42 comprises a threaded circular nut which screws onto the threads 62 on the body 38. Parallel flats 82 cut as chords partially into opposite sides of one face of the collar 42 provide a gripping surface for a tool to adjust the collar 42 on the body 38. The outer surfaces of both the cover 40 and the collar 42 may be knurled to ease adjustment.

The ignition system 12 is installed in the rifle 10 through the breech end 16 of the barrel 14 with the bolt 22 removed. First, the locking collar 42 is placed on the body 38 and the threaded shank 44 of the body 38 is screwed almost entirely into the threaded bore 32 of the breech plug 24. A portion of the body 38 will then be inside the outer bore 34 of the breech plug 24. The final position of the body 38 in the breech plug 24 is set by orienting the primer cutout 58 so that it faces out through the side opening 26 in the barrel 14. The locking collar 42 is then tightened against the breech plug 24 to lock the position of the body 38 in the breech plug 24. Finally, the cover 40 is screwed onto the body 38, and the lever 76 is screwed into the cover 40.

When properly adjusted, primer cutout 58 in the primer chamber 52 of the body 38 faces outwardly through the side opening 26. When the cutout 68 in the cover 40 is aligned with the cutout 58 in the body 38, the primer 36 may be radially inserted into the primer chamber 52 through the aligned cutouts 58, 68. The cover 40 is then rotated by means of the lever 76 to enclose the primer 36 securely within the primer chamber 52. The threads on the cover 66 and the threads on the body 62 should be oriented so that when a primer 36 is in the primer chamber 52 and the cover 40 is rotated closed, the bulkhead 64 on the cover 40 contacts the flange 54 of the primer 36 and snugs the primer 36 into the primer chamber 52, to frictionally hold the cover 40 closed.

After the rifle 10 is fired, the cover 40 is opened and the primer 36 can fall out. The lever 76 is preferrably located on the body 38 such that when it is pushed upwards to open the cover 40, the lever 76 contacts the upper edge of the opening 26 and stops, leaving the cutouts 58, 68 aligned. Sufficient clearance is provided between the primer casing 53 and the walls of the primer chamber 52 to allow the primer 36 to easily fall out, even when the rifle 10 has been repeatedly fired causing a slight build up of residue in the ignition system 12.

Figure 4:
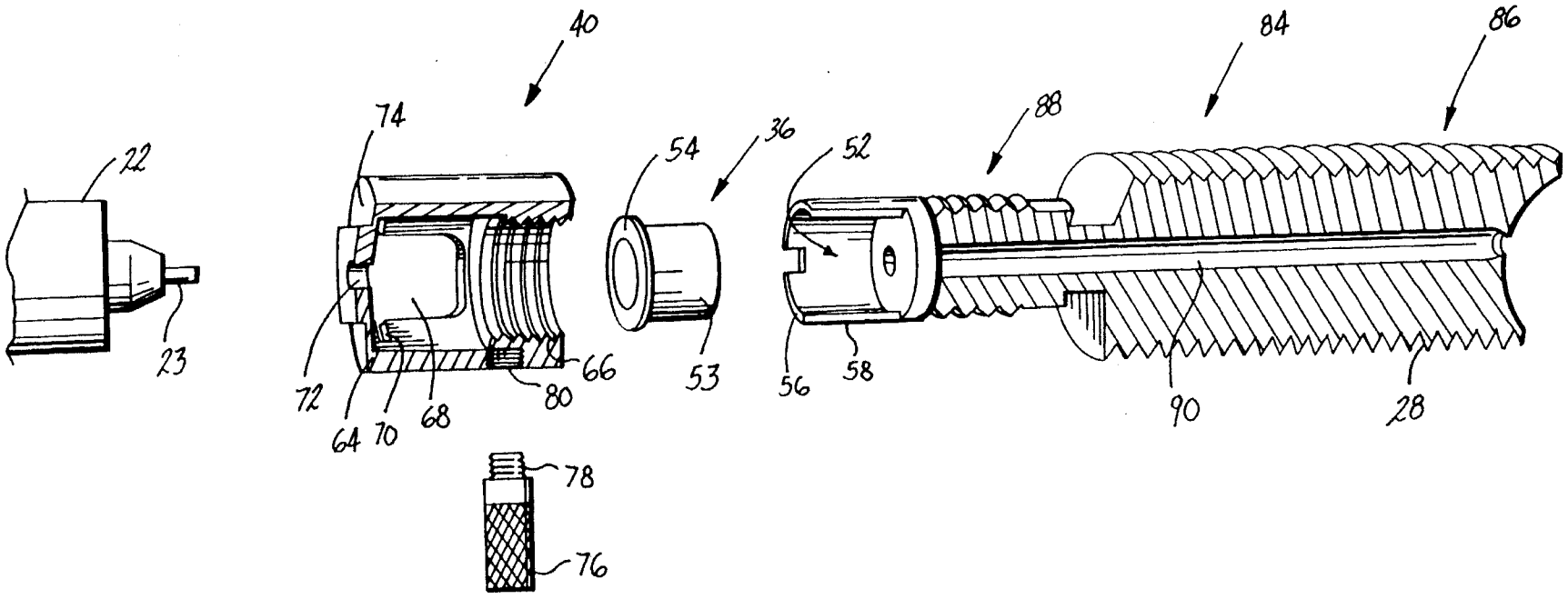
FIG. 4 is an exploded partial sectional side view of an alternative embodiment of an ignition system according to the invention.

FIG. 4 shows an alternative embodiment of the ignition system 12 according to the invention. It is equivalent in all respects to the first embodiment of the ignition system shown in FIGS. 1–3, with the exception that the body 38 of the ignition system 12 is integral with the breech plug 24. Whereas the first embodiment is primarily intended as a retrofit for rifles originally using a percussion cap nipple, the alternative embodiment of FIG. 4 is primarily intended for use in rifles incorporating the radially loading ignition system 12 as original equipment.

The breech plug 24 and body 38 are combined to form a breech plug-body 84. The breech plug-body 84 comprises a threaded plug section 86 for screwing into the threads (not shown) in the bore of the gun barrel 20, and a narrower diameter body section 88. The body section 88 comprises the primer chamber 52, and the threads 62 for receiving the cover 40. A central plug-body bore 90 provides a passage for the hot ignition gasses from the primer 36 to the charge of black powder in the bore of the barrel 20 forward of the breech plug-body 84. The plug-body bore 90 can be narrowed at the forward end of the breech plug-body 84, thus limiting the amount of blow back gasses from the exploding black powder charge which enter the ignition system 12, yet still allowing a large passage over most of the ignition gas's path to reduce clogging. The threads 28 on the plug section 88 should be cut so that when the breech plug-body 84 is fully screwed into the barrel 14, the primer cutout 58 is facing out of the side opening 26 of the rifle barrel 14. Thus, the need for the adjusting collar 42 is eliminated.

Figure 5:
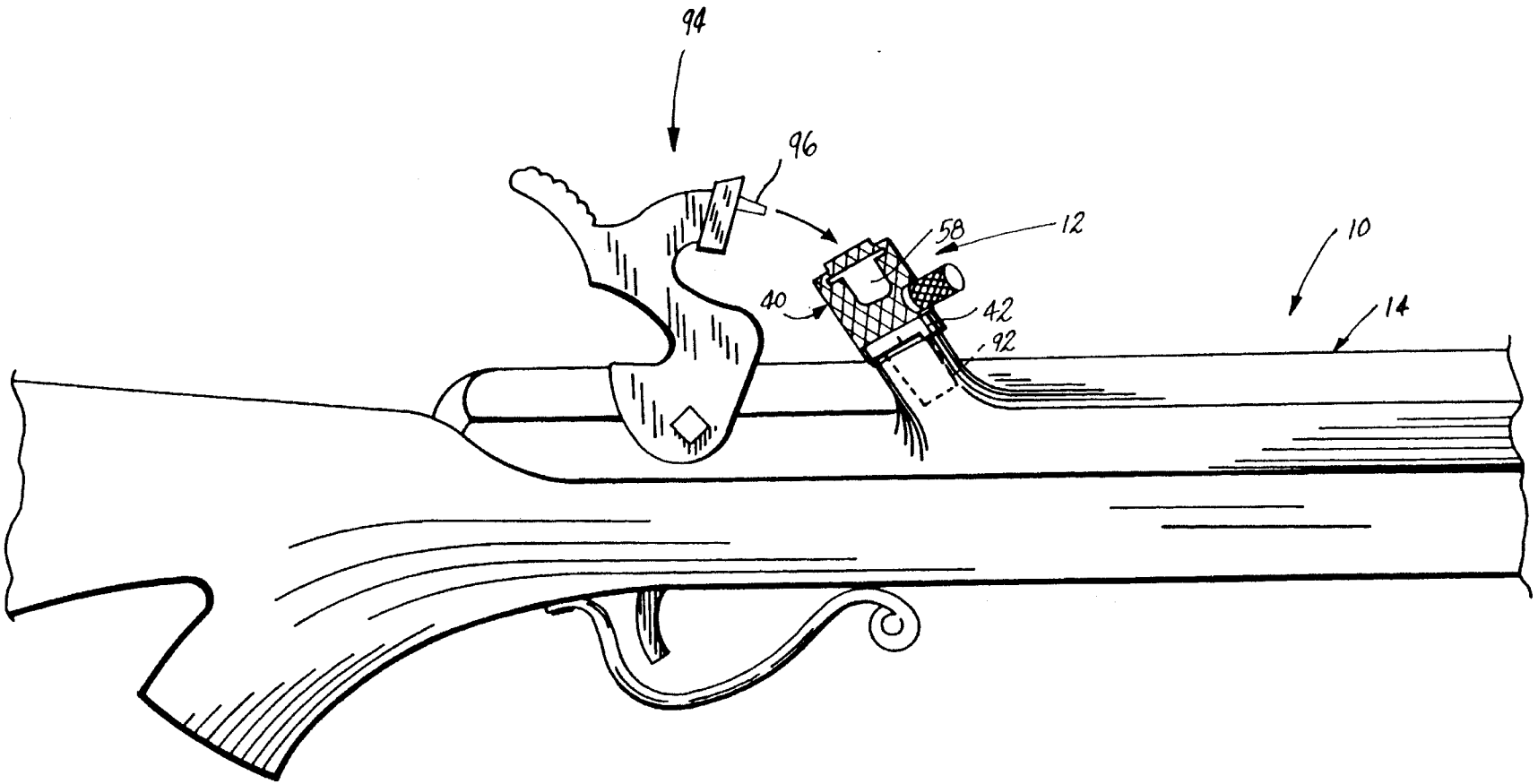
FIG. 5 is a side view of a conventional swing hammer type muzzle loading rifle incorporating the ignition system of FIG. 1.
Figure 5A:
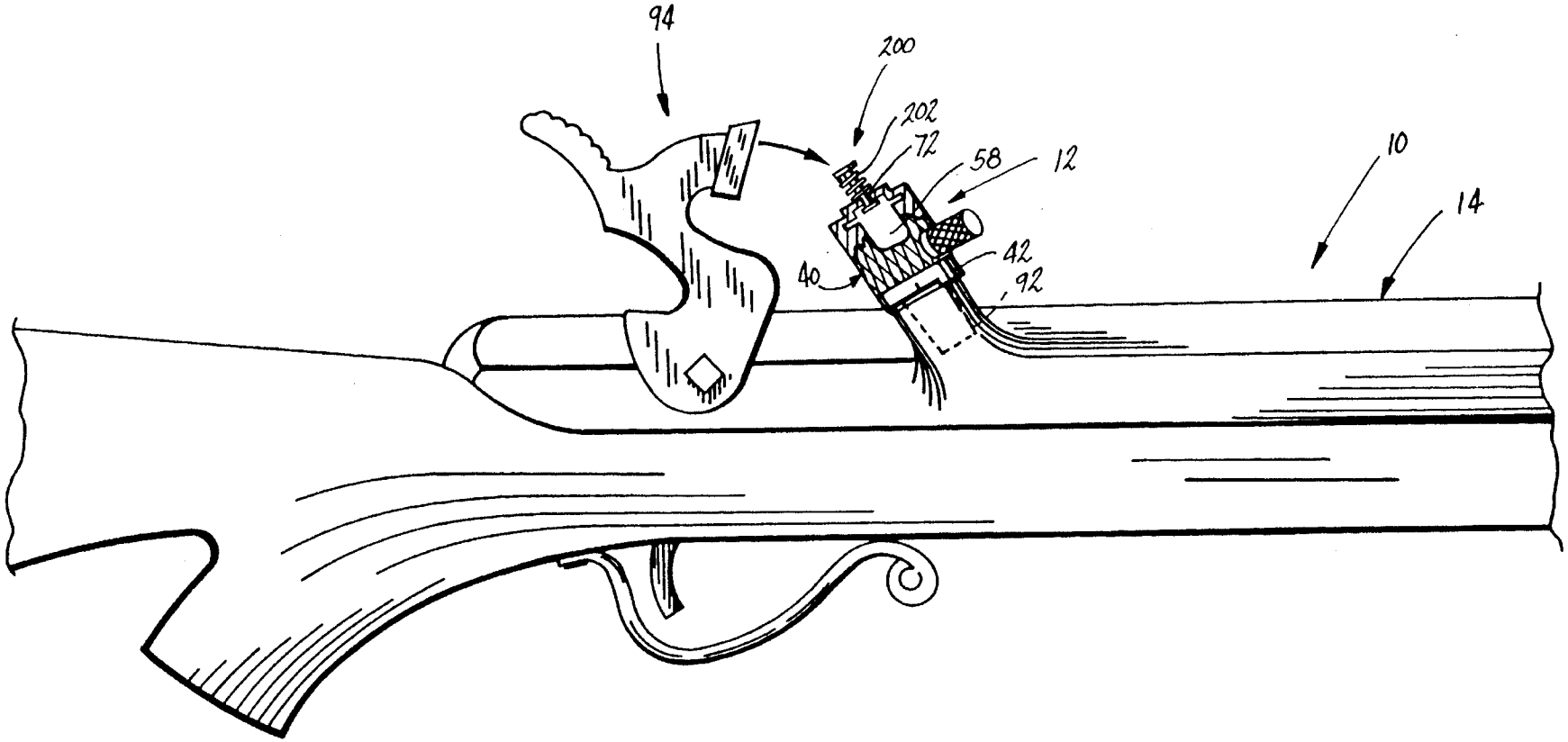
FIG. 5A is a side view of a second embodiment of a conventional swing hammer-type muzzle loading rifle incorporating the ignition system according to the invention; and, FIG. 6 is a perspective view of a primer holder according to the invention.
Figure 9:
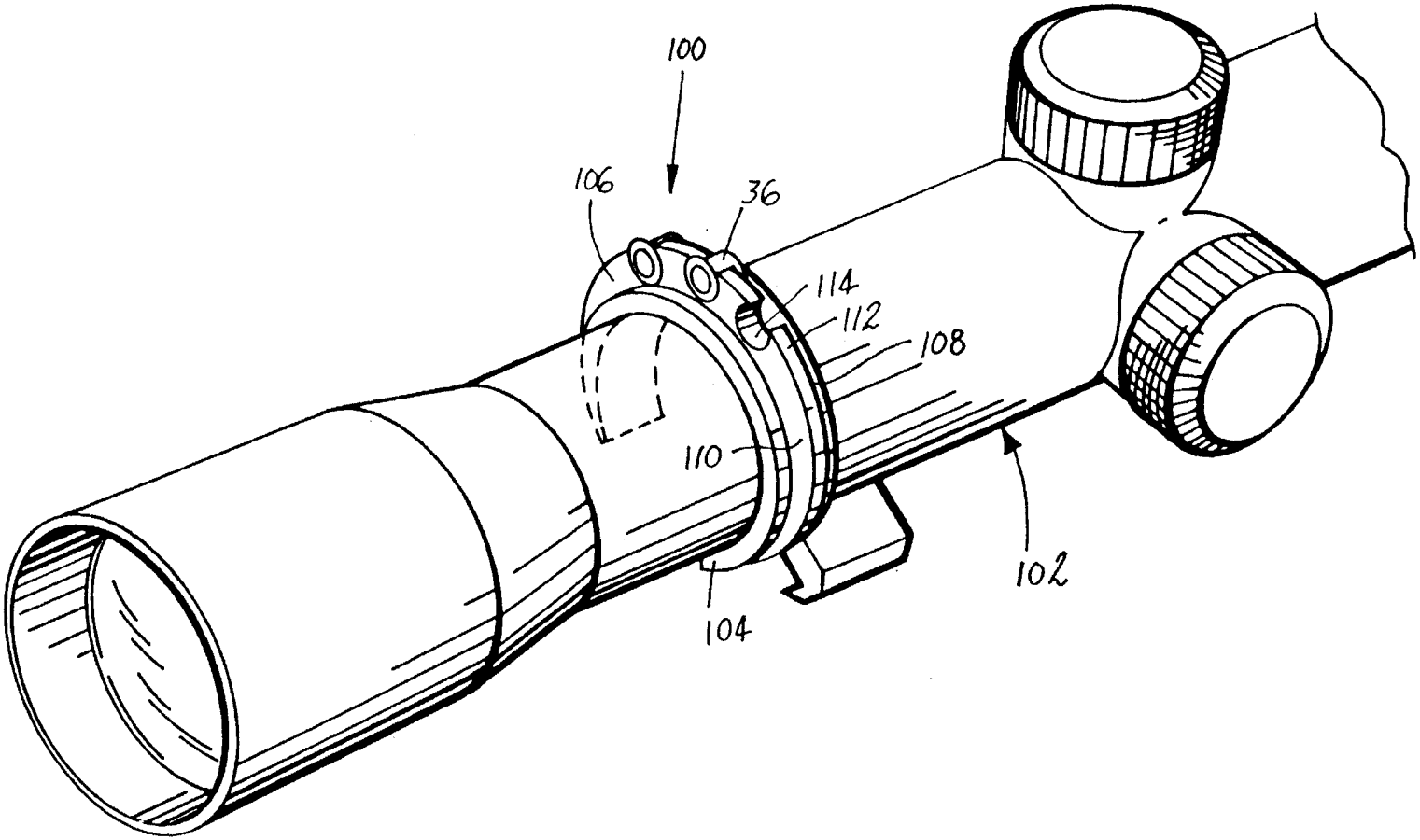

FIG. 5 shows an alternative use for the first embodiment of the ignition system 12. Although the preferred use of the ignition system 12 is in an in-line firing muzzle loading rifle, it is also appropriate for use in a conventional swing hammer muzzle loading rifle. The ignition system 12 replaces the percussion cap nipple (not shown). The shank 44 of the body 38 screws into a threaded hole 92 which originally received the percussion cap nipple. The adjusting collar 42 adjusts the position of the primer cutout 58 to a convenient position. The rifle 10 is fired by means of a rotatable swing hammer 94 having a firing pin 96 which extends into the ignition system 12 when the rifle 10 is fired to ignite the primer 36. In an alternative embodiment shown in FIG. 5A, the firing pin 96 is mounted in the hole 72 in the cover 40 and biased outwardly by means of a spring 202. When used to retrofit an existing swing hammer percussion nipple ignition system, this allows use of the original swing hammer 94 without modification.

To store extra primers 36, a primer holder 100 is proposed for mounting onto an appropriate curved surface of the rifle 10 such as a conventional rifle scope 102 as shown in FIG. 6, or alternatively the barrel 14, or a stock of the rifle 10. The primer holder 100 comprises a semi-circular ring 104 of elastomeric material having a central radial rib 106 extending outwardly radially therefrom. The ring 104 is adapted to fit the contour of its intended mounting location. The rib has 106 faces 108, 110 and an outer radial edge 112. Semi-circular holes 114, sized to receive primers 36, are drilled normal to the faces 108, 110 of the rib 106, and preferably interrupt the radial edge of the rib 112 so that the primers 36 can be inserted into the holes 114 radially. The primer holder 100 is preferably formed of urethane, 90 compression, or other suitable elastomeric material so that the holder 100 may be snapped onto the scope 102 yet firmly retained.

Reasonable variation and modification are possible within the scope of the foregoing disclosure and drawings without departing from the spirit of the invention, as defined in the accompanying claims. For instance, the ignition system 12 could be adapted to hold a standard rifle cartridge primer or a standard percussion cap.

The embodiments of the invention in which an exclusive property or privilege is claimed are as follows:

1. A holder for spare primers comprising:

a semicircular ring adapted to snap onto a receiving surface of a gun, said ring having holes therethrough for receiving primers, each hole being sized to frictionally retain a primer.

2. A holder for spare primers according to claim 1 wherein the semicircular ring is formed at least in part of elastomeric material.

3. A holder for spare primers according to claim 1 wherein the ring comprises a radially outwardly extending rib, the holes penetrating the rib axially.

4. A holder for spare primers according to claim 3 wherein at least one of the holes interrupts the radial edge, thereby defining a gap whereby to receive a primer in snap-fit engagement through the gap.

5. A holder for spare primers according to claim 3 wherein a radially outer edge of the rib near the annular ends of the ring has a radius less than the radius intermediate the annular ends.

6. A holder for spare primers according to claim 5 wherein at least one of the holes interrupts the radial edge, thereby defining a gap whereby to receive a primer in snap-fit engagement through the gap.

* * * * *